United States Patent [19]

Stone

[11] Patent Number: 4,852,764

[45] Date of Patent: Aug. 1, 1989

[54] POUR SPOUT CLOSURE

[75] Inventor: James L. Stone, Grand Rapids, Mich.

[73] Assignee: Packaging Corporation of America, Evanston, Ill.

[21] Appl. No.: 235,387

[22] Filed: Aug. 22, 1988

[51] Int. Cl.[4] ..... B65D 5/74

[52] U.S. Cl. ..... 220/315; 206/621.7; 229/125.09; 229/125.14; 229/125.15; 220/339

[58] Field of Search ..... 220/85 SP, 315, 339; 206/621.3, 621.4, 621.7; 229/125.09, 125.11, 125.14, 125.15, 125.42

[56] References Cited

U.S. PATENT DOCUMENTS

| | | | |
|---|---|---|---|
| 2,926,832 | 3/1960 | Negoro | 229/125.14 X |
| 3,250,436 | 5/1966 | Kurtz | 229/125.15 X |
| 3,266,055 | 8/1966 | Graybill | 206/621.7 |
| 3,900,155 | 8/1975 | Rausing et al. | 229/125.09 |
| 4,113,103 | 9/1978 | Carlsson | 229/125.09 X |
| 4,126,263 | 11/1978 | Martensson | 206/621.7 |
| 4,197,949 | 4/1980 | Carlsson | 206/621.7 X |
| 4,705,197 | 11/1987 | Gordon et al. | 206/621.7 X |
| 4,730,769 | 3/1988 | Stark | 229/125.15 |
| 4,732,315 | 3/1988 | Gunn | 229/125.09 |
| 4,759,478 | 7/1988 | Richardson et al. | 220/339 X |
| 4,760,938 | 8/1988 | Wegner | 222/498 |
| 4,770,325 | 9/1988 | Gordon et al. | 229/125.42 X |
| 4,775,098 | 10/1988 | Peer, Jr. et al. | 229/125.09 X |

*Primary Examiner*—John Rivell

*Attorney, Agent, or Firm*—Neuman, Williams, Anderson & Olson

[57] ABSTRACT

A pour spout closure is provided having a base section and a cover section hingedly mounted thereon for selective movement between open and reclose positions. The base section is affixed to a surface of a container and in proximity to an opening formed in such surface. The base section has formed therein a dispensing aperture which is exposed when the cover section is in an open position. The dispensing aperture is in registered relation with the container opening. A flap, connected to a portion of the base section circumjacent the dispensing aperture, is folded relative thereto whereby a peripheral portion of the flap is adjacent the perimeter of the container opening. The cover section is provided with a protuberance which is sized to extend into the container opening when the cover section is in a reclose position. A predetermined exterior portion of the cover section protuberance is yieldably engaged by the flap peripheral portion when the protuberance extends into the container opening.

12 Claims, 3 Drawing Sheets

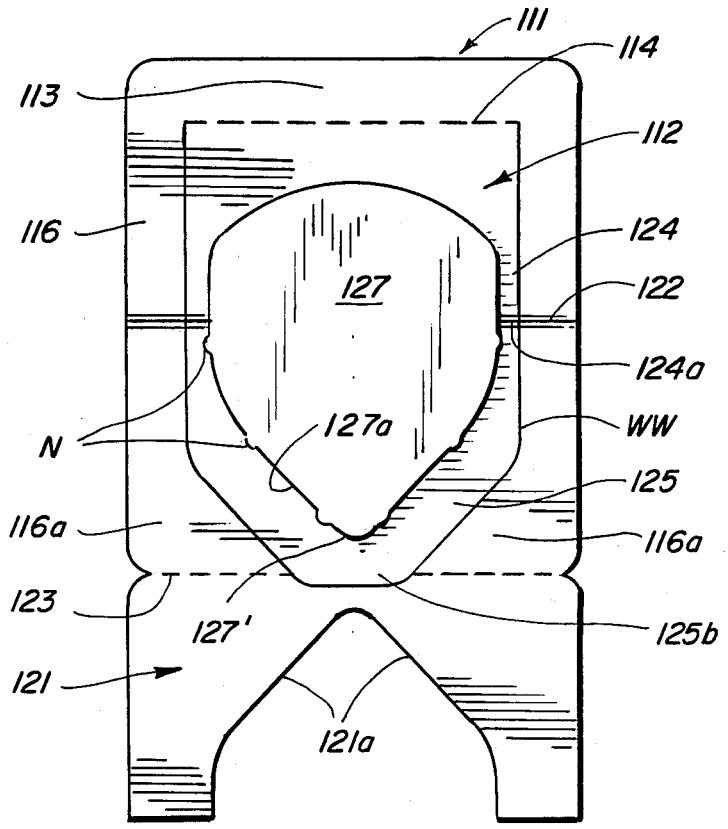
FIG. 6
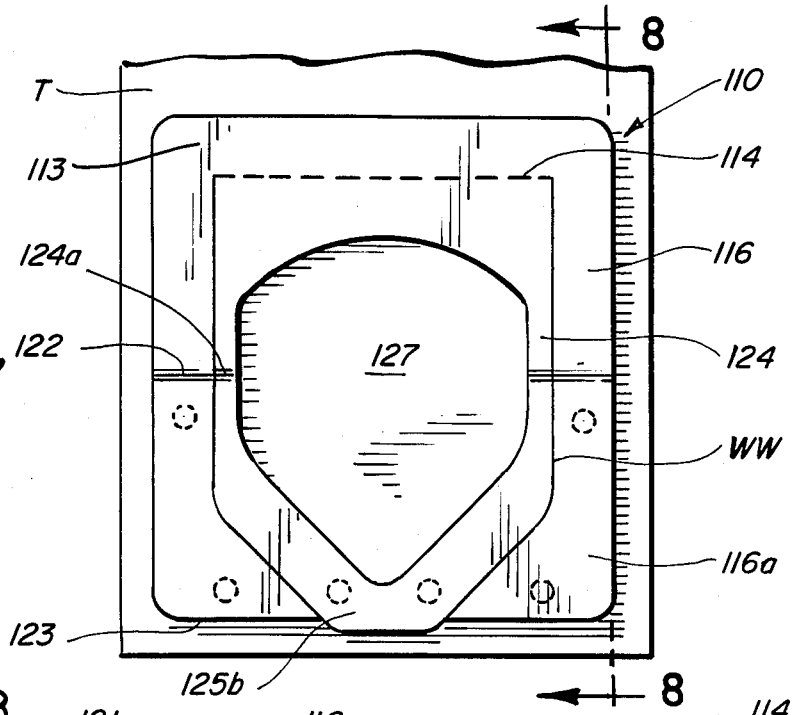
FIG. 7
FIG. 8
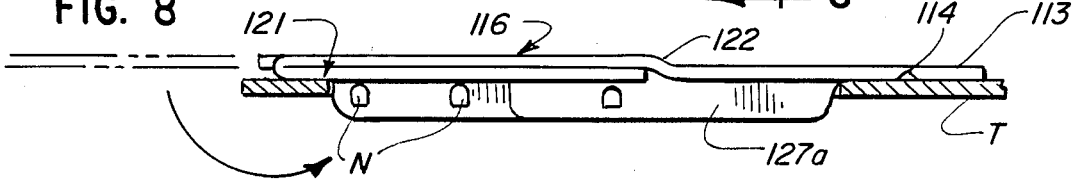

POUR SPOUT CLOSURE

BACKGROUND OF THE INVENTION

Pour spout closures of various types have been utilized for a long period of time in combination with various containers for granular products wherein the entire contents of the container are not normally dispensed at one time. Thus, to preserve and protect the remainder of the contents within the container, the closure must be readily capable of assuming an effective reclose position.

Heretofore such closures were beset with one or more of the following shortcomings: (a) they were of costly, complex and/or fragile construction; (b) they could not be readily attached to the container by high speed equipment which was compatible with conventional slitting, slotting and scoring equipment utilized in forming container blanks; (c) the manipulation of the closures by the customer was oftentimes awkward and frustrating; (d) the closures were susceptible to accidental opening; and (e) they embodied an inordinate number of component parts.

SUMMARY OF THE INVENTION

Thus, it is an object of the invention to provide a pour spout closure which avoids all of the aforenoted shortcomings besetting the prior art.

It is further object to provide an improved pour spout closure which is of unitary construction and formed of inexpensive plastic material.

It is a still further object to provide an improved pour spout closure which enables a customer to readily ascertain whether there has been tampering of the container prior to purchase thereof.

Further and additional objects will appear from the description, accompanying drawings, and appended claims.

In accordance with one embodiment of the invention, a pour spout closure, sometimes referred to as a fitment, is provided for use on a container for granular products and the like. The closure is of unitary construction and includes a base section and a cover section mounted thereon for selective hinged adjustment between open and reclose positions. The base section has first and second marginal portions affixed to a surface of the container having an opening formed therein. The base section also includes a third marginal portion having a flap foldably connected to a peripheral edge thereof and secured in a folded position to the underside of the third marginal portion. The folded flap has an edge portion thereof adjacent to the perimeter of the container opening. The cover section is provided with a protuberance which is sized to enter the container opening when the cover section is in an initial unopened position or a reclose position. The cover section includes a laterally extending tab which projects beyond the base section third marginal portion and the folded flap secured thereto. The cover section protuberance is frictionally engaged by the flap edge portion when the cover section is in either the initial unopened position or a reclose position.

DESCRIPTION

For a more complete understanding of the invention reference is made to the drawings, wherein:

FIG. 6 is a bottom view of a second embodiment of the improved pour spout closure prior to being affixed to a container surface.

FIG. 7 is a top plan view of the closure of FIG. 6 shown affixed to a container surface.

FIG. 8 is an enlarged sectional view taken along line 8—8 of FIG. 7.

Figure 3:
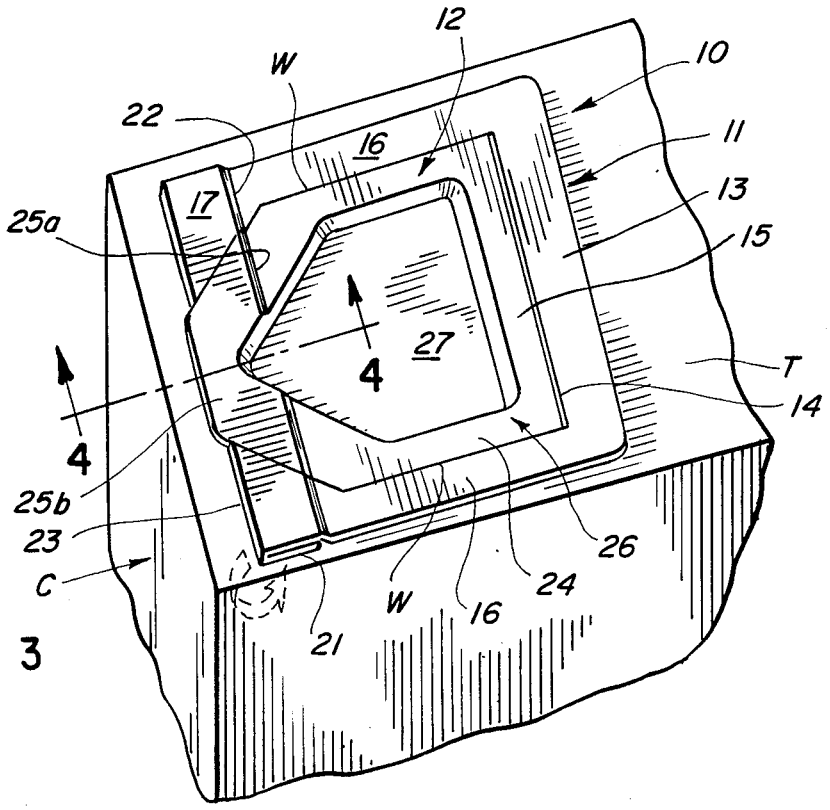
FIG. 3 is similar to FIG. 1 but showing the closure of FIG. 1 in an initial unopened position and attached to a container surface.
Figure 4:
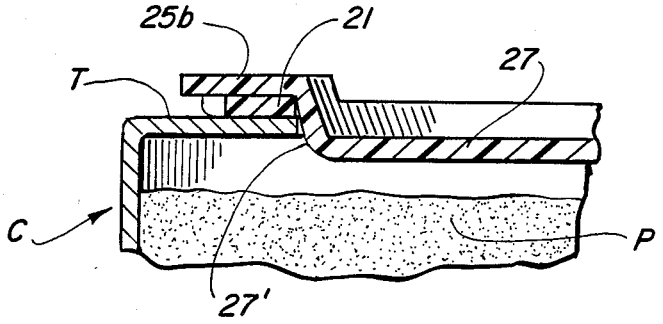
FIG. 4 is an enlarged fragmentary sectional view taken along line 4—4 of FIG. 3.
Figure 5:
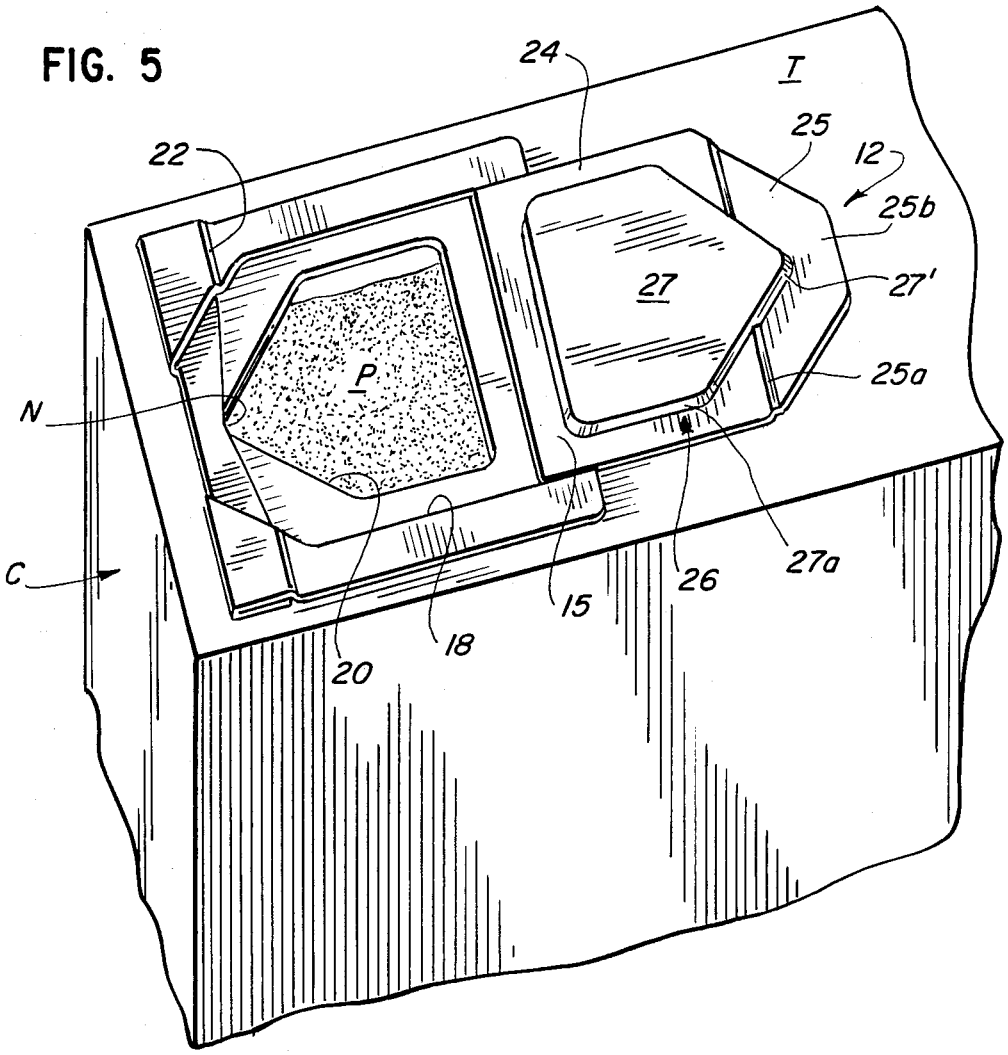
FIG. 5 is similar to FIG. 3 but showing the cover section in a fully open position.

Referring now to the drawings and more particularly to FIGS. 3–5, one embodiment of the improved pour spout closure 10 is shown mounted on the exterior surface of an exposed top closure flap T of a foldable container C. As an alternative the closure may be attached to the upper portion of a narrow side wall of the container. The container is adapted to accommodate a predetermined volume of a granular product such as detergent, flour, grass seeds, etc. The container, prior to being set up and loaded, may assume a collapsed tubular configuration, not shown.

The pour spout closure 10 is of unitary construction and may be thermo-formed from a thin sheet of plastic material (e.g., PETG or glycol modified polyethylene terephthalate having a thickness of 15 MIL). Closure 10 includes a base section 11 and a cover section 12 mounted thereon for selective hinge adjustment between an open position (FIG. 5) and an initial unopened position (FIG. 3) or reclose position.

The base section 11 has a first marginal portion 13 which is connected by a hinge line 14 to an adjacent portion 15 of the cover section 12. Extending angularly from opposite ends of first marginal portion 13 are second marginal portions 16. The distal ends of the second marginal portions 16 are interconnected by a transversely extending third marginal portion 17. The marginal portions 13, 16 and 17 cooperate with one another to form a dispensing aperture 18 in the base section 11. The dispensing aperture 18, which is exposed when the cover section 12 is in the open position, is in registered relation with an opening 20 provided in the container C and through which the accommodated product P is dispensed from the container when the latter is tilted downwardly. As noted in FIG. 5, the dispensing aperture 18 is substantially larger in size than container opening 20.

Figure 1:
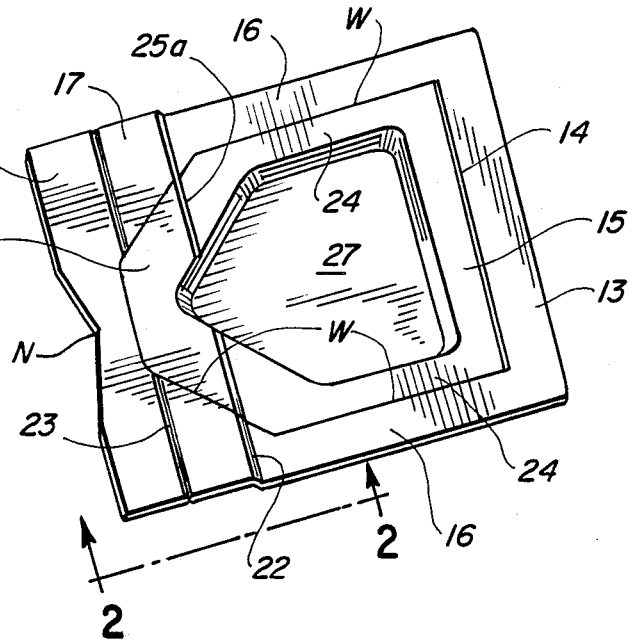
FIG. 1 is a fragmentary perspective top view of one embodiment of the improved pour spout closure prior to the base section flap assuming its folded position.
Figure 2:
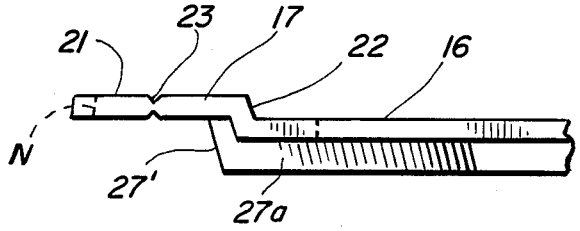
FIG. 2 is an enlarged fragmentary side elevational view of the closure of FIG. 1.

Foldably connected to the outer edge of marginal portion 17 is a flap 21, the latter having a centrally disposed notch N formed in the edge thereof, see FIG. 1, Prior to the closure 10 being attached to the container surface, the flap 21 is folded under and affixed to marginal portion 17, see FIGS. 3 and 4. To compensate for the increased thickness of the base section in the area of marginal portion 17 due to the folded flap and in order to have the undersurface of the folded flap in coplanar relation with the undersurfaces of marginal portions 13 and 16, the connection 22 between portions 16 and 17 is offset outwardly by an amount equal to the thickness of flap 21. Thus, when the closure is to be affixed to the container surface, either the coplanar under surfaces of marginal portions 13 and 16 and folded flap 21 are coated with a suitable adhesive or the area of the container surface to be subsequently engaged by the base sections has first applied thereto a suitable adhesive.

The width of flap 21 measured perpendicular to the foldline connection 23 between the flap and marginal portion 17 and the depth of notch N are such that the central portion of the notch will be disposed adjacent the perimeter of the container opening 20 and project a small amount into the area of the opening, see FIG. 5.

As aforementioned cover section 12 is connected to marginal portion 13 by hinge line 14, whereby the base section and the cover section remain integrally connected to one another regardless of the position of adjustment of the cover section. Portion 15 of the cover section cooperates with side and front portions or segments 24 and 25, respectively, incorporated in the cover section to form a flange-like rim or frame 26 which encompasses an exposed surface of a protuberance or plug 27 formed in the cover section. The front portion 25 of frame 26 is provided with a step 25*a* which compensates for the offset connection 22 formed in base section 11.

When the cover section 12 is in the initial unopened position, the side portion 24 and segments of the front portion 25 are preferably connected by elongated tear webs or weakened scorelines W to corresponding marginal portions 16 and 17 of the base section 11, see FIGS. 1 and 3. The webs W are torn, when the cover section 21 is manually pivoted about hinge line 14 from the initial unopened position to the open position. Thus, if the webs W are torn at the time of purchase of the container, the customer will know that there has been possible tampering of the container.

To facilitate pivoting of the cover section 12, a tab or tongue-like segment 25*b* formed on the front portion 25 of the cover section frame 26 projects beyond the edge of portion 17 defined by the foldline connection 23, see FIG. 3. As seen in FIG. 4, the tab 25*b* is spaced outwardly from the container surface T thus, facilitating grasping of the tab.

The protuberance 27 is sized so that when it enters the container opening 20, the central portion of the notch N of folded flap 21 will frictionally engage a nose-shaped portion 27' of the protuberance.

The frame portions 15 and 24 of the cover section 12 are adapted to engage the surface of the container circumjacent the opening 20 and thus limit the extent to which the protuberance 27 can be inserted into the opening upon the cover section assuming a reclose position.

A second embodiment of the improved pour spout closure 110 is shown in FIGS. 6–8. Closures 10 and 110 are similar in construction and components of closure 110 which are similar to those of closure 10 will be numbered the same except in a one hundred series. Closure 110 is of unitary construction and is preferably thermo-formed from the same material as that of closure 10. Closure 110 includes a base section 111 which has predetermined portions thereof affixed by adhesive or the like to the container surface T which is circumjacent the opening 20 formed therein. A cover section 112 is hingedly connected by foldline 114 to a marginal portion 113 forming a segment of the base section 111. Extending angularly from opposite ends of portion 113 are marginal portions 116 which are disposed on opposite sides of the container opening 20. The distal ends 116*a* of marginal portions 116 are offset inwardly towards one another but are separated from one another by a finger tab 125*b* provided on the cover section 112. When the closure 110 is initially formed, the marginal portions 116 and their distal ends 116*a* are connected to adjacent segments 124 and 125 of the cover section 112 by a pair of tear webs or weakened scorelines WW, see FIG. 6.

Connected by foldline 123 to the distal ends 116*a* of the marginal portions 116 is a flap 121. The outer edge of flap 121 is contoured at the center to conform substantially to the shape of the nose portion 127' of the protuberance 127 formed in the cover section 112. Prior to closure 110 being affixed to the container surface T, flap 121 is folded and affixed to the underside of the distal ends 116*a* and partially to the underside of marginal portions 116 of the base section, see FIG. 8. Because of the increased thickness of the closure 110 due to the folded flap 121, each marginal portion 116 of the base section 111 is provided with a step 122, offset outwardly by an amount substantially equal to the thickness of the material. Thus, the underside of the folded flap is substantially coplanar with the underside of other portions (e.g. 113) of the base section thereby providing substantial areas for affixing the base section to the container surface T, see FIGS. 7 and 8. Likewise, the segments 124 of the cover section 112 are provided with similar outwardly offset steps 124*a* which are in endwise alignment with the steps 122 formed in the base section, see FIG. 7. When the flap 121 is disposed in its folded subtending position with respect to the base section marginal portions 116, the contoured edge 121*a* of the flap will be disposed proximate to and extend a short distance into the area defined by the container opening 20.

Cover section 112 is provided with a central protuberance 127 which is sized to enter the container opening 20 when the cover section is in either an initial unopened position or a reclose position. As noted in FIGS. 6 and 8, the side wall 127*a* of the protuberance 127 is provided on the exterior thereof with a plurality of laterally spaced projections sometimes referred as nibs N. When the cover section 112 is in its initial unopened position or reclose position, the nibs N will be disposed beneath the edge 121*a* of the folded flap 121. Thus, the edge 121*a* will yieldably retain the cover section in either the initial close or reclose position. To initially open or reopen the cover section requires a nominal predetermined external pulling force to be applied to the tab 125*b* of the cover section causing the flap edge 121*a* to be distorted slightly so as to allow the nibs N to pass thereby. The number and relative location of the nibs on the cover section protuberance may vary from that shown, if desired.

While the container opening 20 and the cover section protuberance 27 or 127, as illustrated have a substantially pentagonal configuration, the invention is not intended to be limited thereto. The protuberance and the container opening should have substantially the same configuration (e.g., circular, triangular, etc.). Furthermore, the location of the closure 10 or 110 on the container and the size and shape of the closure may also vary from that shown without departing from the scope of the invention.

I claim:

1. A pour spout closure of unitary construction for mounting proximate an opening formed in a surface of a container, comprising a base section adapted to be affixed to a portion of the container surface circumjacent the opening; and a cover section hingedly connected to a first portion of said base section and selectively movable relative thereto between open and reclose positions, said cover section having peripheral segments disposed adjacent corresponding second portions of said base section, said cover section being provided with a protuberance sized for entering the container opening when the cover section is in a reclose position; said base section having a foldable flap disposed in a folded relation with a second portion of said base section, said folded flap having an edge thereof engaging said cover section protuberance exterior when the latter is disposed within the container opening and retain said cover section in a reclose position.

2. The pour spout closure of claim 1 wherein the flap of the base section is disposed opposite the hinge connection between the cover section and the base section.

3. The pour spout closure of claim 2 wherein the base section flap has an outer edge formed to frictionally accommodate a portion of the cover section protuberance when the cover section is in a reclose position.

4. The pour spout closure of claim 1 wherein said closure is formed of thin plastic material and a portion of the base section connected to the foldable flap is offset outwardly whereby an underside of the folded flap is substantially coplanar with an underside of a predetermined portion of said base section.

5. The pour spout closure of claim 1 wherein a peripheral segment of the cover section projects beyond the folding connection of the base section flap.

6. The pour spout closure of claim 5 wherein the projecting peripheral segment of the cover section at least partially defines a pull tab for the cover section.

7. The pour spout closure of claim 3 wherein the outer edge of the folded flap is provided with a notch for frictionally engaging a nose-like portion of the cover section protuberance when said cover section is in a reclose position.

8. A pour spout closure of unitary construction in combination with a foldable container having a surface thereof provided with an opening, said closure comprising a base section having a predetermined portion thereof affixed to the container surface in proximity to the opening therein; and a cover section hingedly connected to said base section and selectively movable relative thereto between open and reclose positions; when said cover section is in an open position, a dispensing aperture is formed in the base section, said dispensing aperture being in registered relation with the surface opening, said cover section having opposed marginal segments initially releasably connected to corresponding marginal portions of said base section, said cover section being provided with a protuberance sized to enter the container opening when the cover section is in a reclose position relative to the base section; said base section including a flap affixed in a folded relation to a portion of said base section, said folded flap having a peripheral segment thereof in frictional engagement with said cover section protuberance when the latter is disposed within the container opening.

9. A pour spout closure formed of thin sheet material for mounting proximate an opening provided in a container surface, comprising a base section; and a cover section hingedly mounted thereon for selective relative movement between open and reclose positions; said base section having a dispensing aperture formed therein and adapted to be in substantial registry with the container opening, said dispensing aperture being exposed when said cover section assumes an open position, a portion of said base section adjacent said dispensing aperture having a segment thereof adjacent the perimeter of the container opening; said cover section being provided with a protuberance sized to enter the container opening when the cover section is in either an initial unopened position or a reclose position, said protuberance having an exterior surface thereof in frictional engagement with said base section portion when said cover section protuberance is disposed within the container opening, said cover section including a rim in substantial encompassing relation with an exposed surface of said protuberance, said rim being adapted to engage in face to face relation a portion of the container surface circumjacent the opening therein thereby limiting the extent to which the protuberance can enter the container opening.

10. The pour spout closure of claim 1 wherein the exterior of the cover section protuberance is provided with at least one nib, the latter subtending the folded flap edge when said cover section is in a reclose position whereby said flap edge yieldably retains said cover section in said reclose position.

11. The pour spout closure of claim 1 wherein the second portions of the base section are provided with steps offset outwardly an amount at least substantially equal to the thickness of the folded flap.

12. The pour spout closure of claim 11 wherein the peripheral segments of the cover section are provided with steps complimental to the steps provided on the second portions of said base section.

* * * * *